US005606840A

United States Patent [19]

Hase

[11] Patent Number: 5,606,840

[45] Date of Patent: Mar. 4, 1997

[54] PANEL AND PANEL STRUCTURE

[75] Inventor: Toshizo Hase, Otsu, Japan

[73] Assignee: Nihon Koshitsu Garasu Kabushiki Kaisha, Shiga-ken, Japan

[21] Appl. No.: 582,620

[22] Filed: Jan. 4, 1996

[30] Foreign Application Priority Data

Jul. 28, 1995 [JP] Japan ..... 7-192815

[51] Int. Cl.[6] ..... E04B 2/60; E04B 2/82

[52] U.S. Cl. ..... 52/780; 52/241; 52/307; 52/781

[58] Field of Search ..... 52/307, 308, 204.71, 52/204.72, 800.11, 800.12, 800.15, 800.17, 474, 764, 777, 780, 781, 459, 460, 461, 463, 464, 467, 468, 241

[56] References Cited

U.S. PATENT DOCUMENTS

| | | | |
|---|---|---|---|
| 982,015 | 1/1911 | Olsen et al. | 52/308 |
| 2,363,164 | 11/1944 | Waller | 52/464 |
| 3,013,642 | 12/1961 | Hammitt et al. | 52/461 |
| 3,423,892 | 1/1969 | Rimington | 52/241 |
| 3,429,090 | 2/1969 | Metelnick | 52/781 |
| 4,033,084 | 7/1977 | Shiflet | 52/459 |
| 4,715,153 | 12/1987 | Rohrman | 52/781 |

*Primary Examiner*—Michael Safavi
*Attorney, Agent, or Firm*—Nikaido, Marmelstein, Murray & Oram LLP

[57] ABSTRACT

A barrier is formed with pairs of elongate first supports having tiop plate portions and side plate portions forming a substantially U-shaped configuration. A flang portion extends from each side plate portion. The top plate portion being formed with a plurality of spaced apart apertures with the side plate portion formed with a plurality of spaced apart slits. Web-like second supports are inserted into the slits of the first supports and have apertures which are aligned with apertures in the top plate portion of the first supports. Block members of rectangular cross-section are held between the first supports and second supports along opposit end and side surfaces with opposite upper and lower surfaces being supported by the second supports. Bolts and nuts serve to fasten the first and second supports together while clamping the block members between the flange portions and side plate portions of the first supports as well as between the second supports.

4 Claims, 6 Drawing Sheets

FIG.4
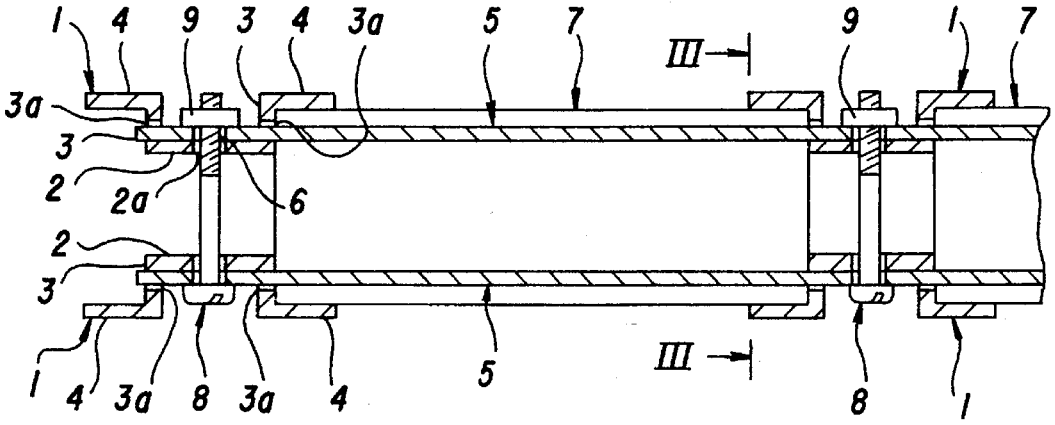
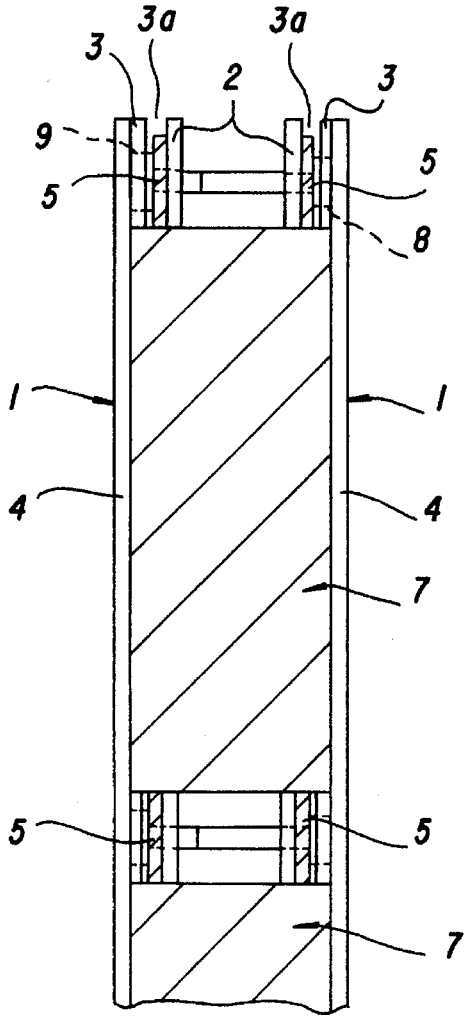
FIG.5

PANEL AND PANEL STRUCTURE

BACKGROUND OF THE INVENTION

1. Field of the Invention

This invention relates to a panel and a panel structure. More specifically, the invention relates to a panel and a panel structure constructed of block members, such as glass bricks or glass blocks, and support members, being suitable for a partition between constructive elements or a screen.

2. Description of the Prior Art

Generally, such panel is constructed by stacking glass blocks within a frame, for example, of aluminum, with adhesive such as joint sealant being interposed between the glass blocks. Alternatively, such panel is constructed by stacking glass blocks directly on a portion of a constructive element, with adhesive such as joint sealant being interposed between the glass blocks.

It is noted, however, that, with the above mentioned panel, adhesive material is required so as to cause the glass blocks to be secured to one another. This requires a long period of time of aging for adhesive material to be cured so that construction period is undesirably extended. Moreover, it is also disadvantageous since constructive element and its periphery are easily contaminated by joint sealant when it is used. It is specifically noted that such panel using a frame cannot easily accommodate alteration of its size, when it is desired to change the size of the panel in relation to the constructive element.

In order to solve the above problems, various proposals have been made heretofore. For example, Japanese Utility Model Publication No. 50-3384 discloses a screen utilizing a glass panel, and Japanese Utility Model Publication No. 52-30739 discloses a glass block panel.

The former Publication proposes a panel unit including a pair of gratings or lattices of synthetic resin having recessed portions in the inner surface thereof, and a plurality of glass plates fitted within the recessed portions and clamped by the gratings. Each end of the unit is engaged in an engagement groove of a pair of each of upstanding support columns disposed opposite ends of the panel unit.

According to the above panel unit, the glass plates are clamped by the pair of gratings, so that it is possible to completely obviate adhesive such as joint sealant. Construction period may be shortened and contamination of a constructive element and its periphery may be avoided.

It is noted, however, that a size of such panel unit is fixed. Thus, it is impossible for a particular panel unit to be changed in size, though assemblage of plurality of such panel units may be changed in size. Hence, application of such panel unit is limited. Furthermore, the glass plates are simply clamped by the pair of gratings, so that support strength for the glass plates becomes lower at the central portion of the panel unit. This causes dropping out of the glass plates from the gratings when high vibration and/or mechanical shock are applied to the gratings.

It is contemplated that the gratings be constructed of a casting, instead of a synthetic resin material. This may solve the above problems, but another problem would be caused that fabrication is restricted due to extremely Increased weight of such gratings.

The latter Publication discloses a glass block panel for the purpose of natural illumination. The glass block panel includes a frame of an aluminum material. Vertical bars and horizontal bars are disposed within the frame. A plurality of glass blocks are disposed between the frame and the vertical and horizontal bars and/or between the vertical bars and the horizontal bars, with a rubber packing being interposed between the glass blocks and the bars and the frame. The frame, the vertical bars and the horizontal bars are secured together at appropriate connection portions by screws.

According to the above-mentioned glass block panel, adhesive such as joint sealant may be completely obviated, as in the case of the former Publication. Thus, construction period may be reduced, and contamination of a constructive element and its periphery may be avoided. Furthermore, breakage due to vibration and/or mechanical shock may be prevented.

It is noted, however, that a rubber packing is needed to be interposed between the glass block and the frame, the vertical bars and the horizontal bars. This makes assembling work complicated, thus reducing operation efficiency. It is particularly noted that the portions of the frame, the vertical bars and the horizontal bars confronting to the glass blocks are configured so as to correspond to the peripheral configuration of a particular glass block, so that it is impossible to use other glass blocks having the same outer dimension but different peripheral configuration. This is disadvantageous in terms of compatibility.

SUMMARY OF THE INVENTION

It is therefore a main object of the invention to provide a panel and a panel structure which has a relatively simple construction so as to facilitate assembling thereof, which has an improved strength when assembled, and which may be easily changed in size to a desired value.

In order to achieve the above object, the invention provides a panel comprising a pair of first supports each including a top plate portion and a pair of side plate portions, the top plate portion and the side plate portions being formed into a substantially U-shaped configuration, each of the side plate portions being formed at its longitudinal edge with a flange portion extending outwardly therefrom, each of the side plate portions being formed with a plurality of slits spaced apart from one another by a predetermined distance, a plurality of web-like second supports insertable into the respective slits in the first supports, and a block member having a rectangular cross-section, wherein the block member is supported, at its opposite end surfaces and at its opposite side surfaces, by the flange portions and the side plate portions of the pair of first supports, and wherein the block member is supported, its opposite upper and lower surfaces, by the second supports inserted into the slits of the first supports.

In accordance with the second invention, there is provided a panel comprising a pair of elongated first supports each including a top plate portion and a pair of side plate portions, the top plate portion and the side plate portions being formed into a substantially U-shaped configuration, each of the side plate portions being formed at its longitudinal edge with a flange portion extending outwardly therefrom, the top plate portion and each of the side plate portions being formed with a plurality of apertures and slits spaced apart from one another by a predetermined distance, a plurality of elongated, web-like second supports insertable into the respective slits in the first supports, the second supports being formed with a plurality of apertures which correspond to the apertures in the top plate portion of the first supports, a plurality of block members having a rectangular cross-section, and fastening means including bolts and nuts, wherein the block members are supported, at their opposite end surfaces and at its opposite side surfaces, by the flange portions and the side plate portions of the pair of first supports, wherein the block members are supported, their opposite upper and lower surfaces, by the second supports inserted into the slits of the first supports, and wherein the first supports and the second supports are clamped together by means of the fastening means through their apertures, so that the block members are clamped by the first supports and the second supports.

In accordance with the third invention, the first supports are oriented in a vertical direction, while the second supports are oriented in a transverse direction.

In accordance with the fourth invention, there is provided a panel structure comprising: a panel including a pair of first supports each having a top plate portion and a pair of side plate portions, the top plate portion and the side plate portions being formed into a substantially U-shaped configuration, each of the side plate portions being formed at its longitudinal edge with a flange portion extending outwardly therefrom, each of the side plate portions being formed with a plurality of slits spaced apart from one another by a predetermined distance, a plurality of web-like second supports insertable into the respective slits in the first supports, and a block member having a rectangular cross-section, wherein the block member is supported, at its opposite end surfaces and at its opposite side surfaces, by the flange portions and the side plate portions of the pair of first supports, and wherein the block member is supported, its opposite upper and lower surfaces, by the second supports inserted into the slits of the first supports; and a third support including a top plate portion and side plate portions formed into a substantially U-shaped configuration, each of the side plate portions being formed at its longitudinal edge with a flange portion extending outwardly therefrom, the flange portion of each of the third support being secured to a constructive element, the side plate portions of the third support being clamped by the pair of flanges of the first support disposed at one end of the panel, so that the panel is attached to the side plate portions of the third support.

BRIEF DESCRIPTION OF THE DRAWINGS

FIG. 4 is a cross-sectional view along line II—II in FIG. 2;

FIG. 5 is a cross-sectional view along line III—III in FIG. 3;

DETAILED DESCRIPTION OF PREFERRED EMBODIMENTS

Figure 1:
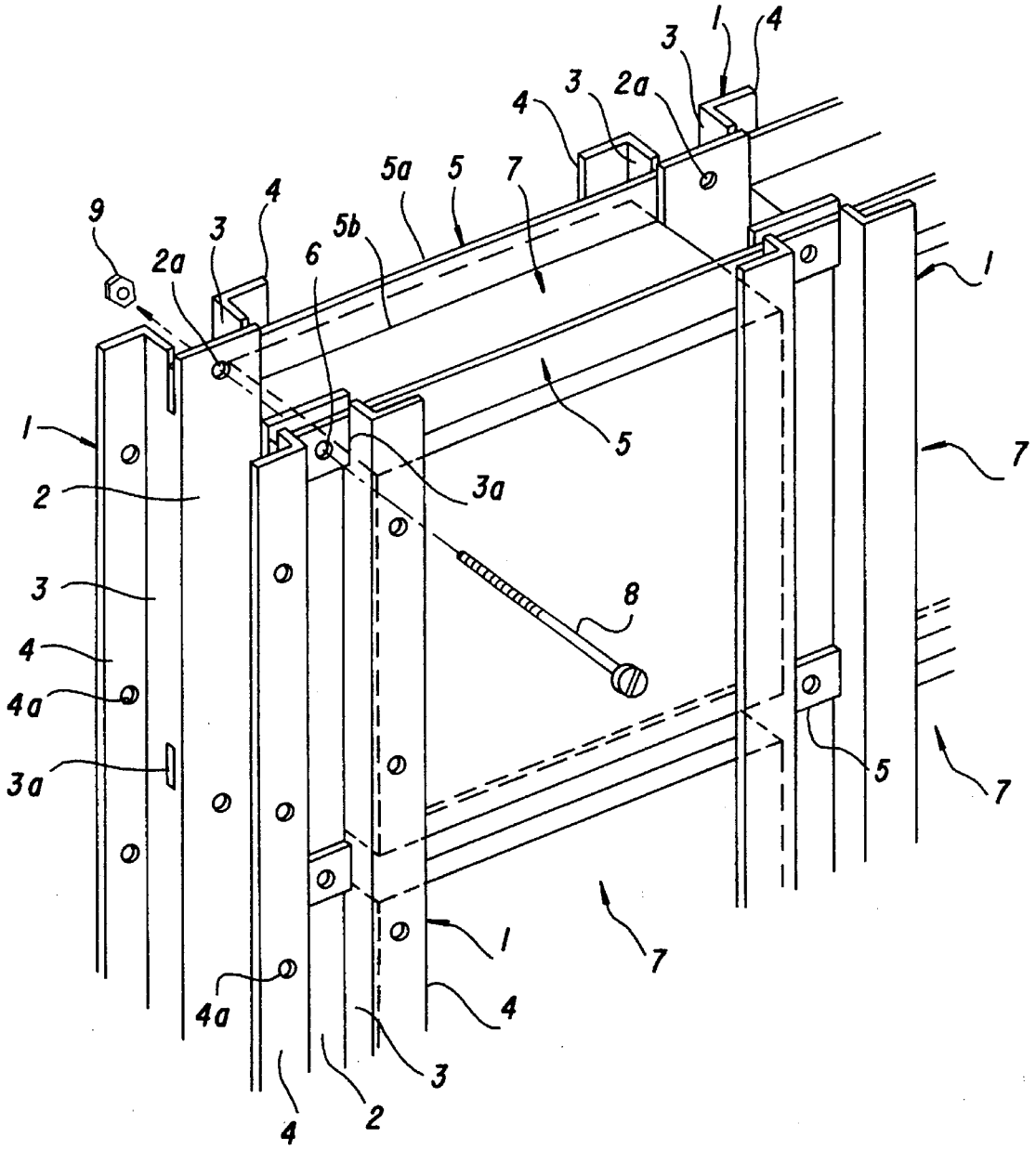
FIG. 1 is a perspective view illustrating portion of one embodiment of the invention.
Figure 2:
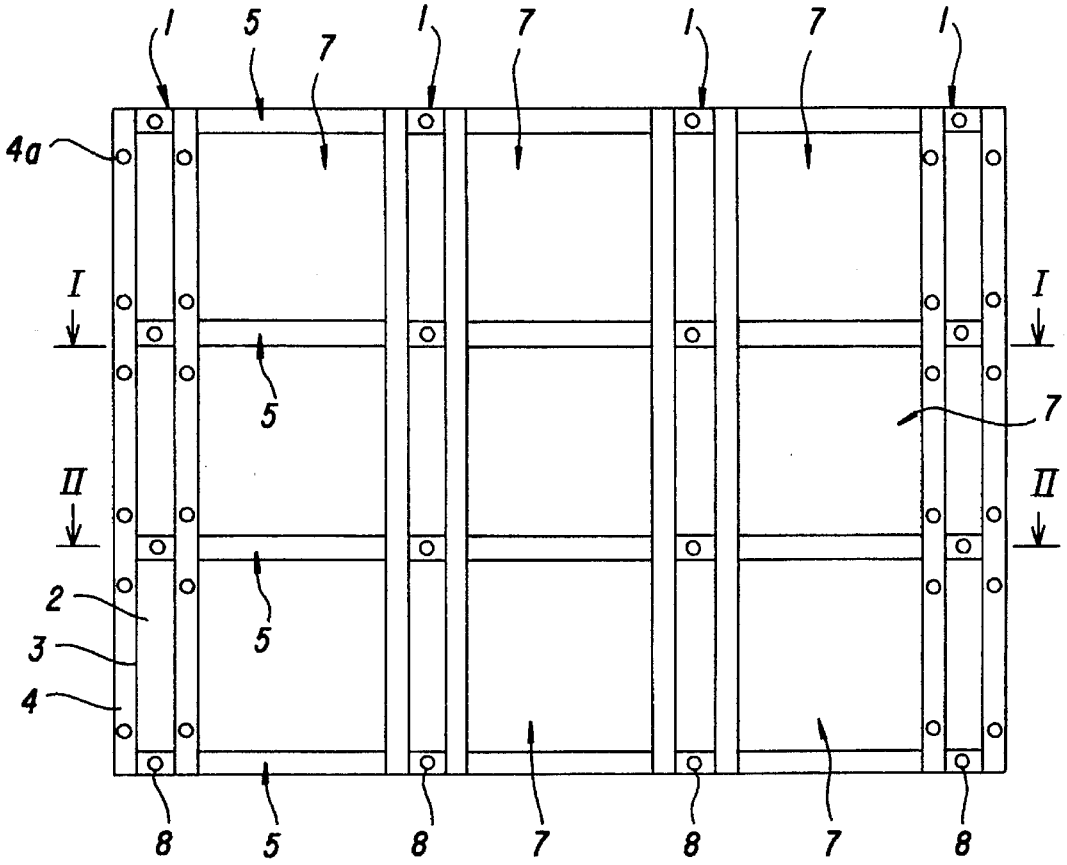
FIG. 2 is a front view of one embodiment of the invention.
Figure 3:
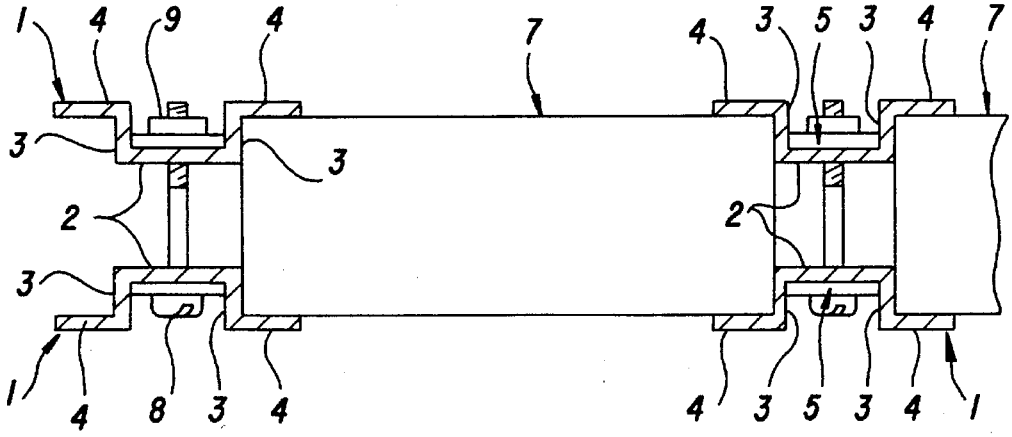
FIG. 3 is a cross-sectional view along line I—I in FIG. 2.
Figure 6:
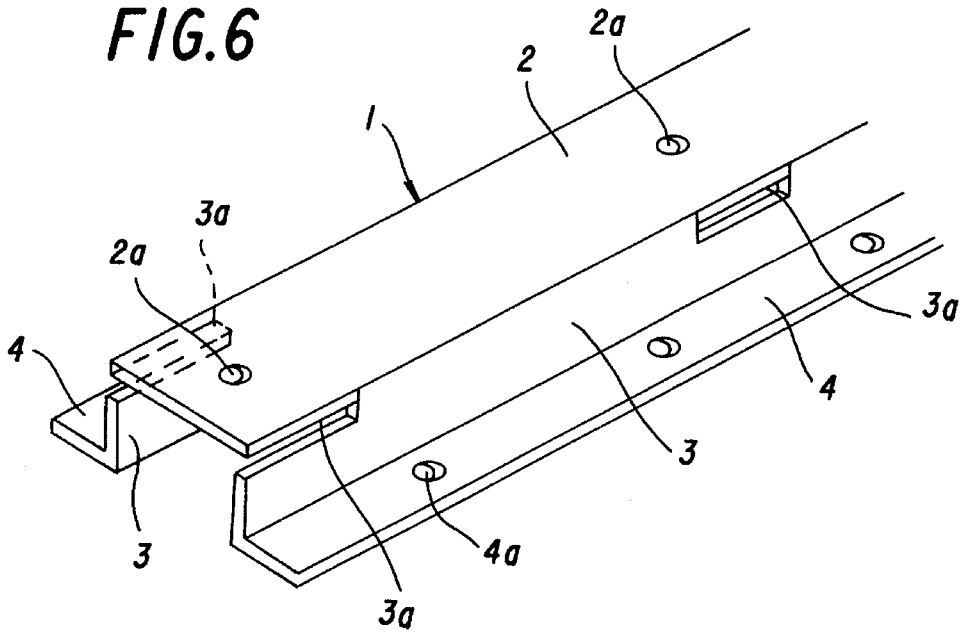
FIG. 6 is a perspective view of a first support according to the invention.

One embodiment of the invention will be explained in detail below with reference to FIGS. 1 to 8. In the drawings, reference numeral 1 denotes a first support formed into an elongated body from a metal member, for example, of aluminum or steel. The first support 1 includes a top plate portion 2 of a flattened configuration, a pair of side plate portions 3 and 3 extending respectively from the opposite sides of the top plate portion 2 in the same direction so as to define, together with the top plate portion 2, a generally U-shaped configuration, and a pair of flange portions 4 and 4 extending outwardly from one end of each of the side plate portions 3 in a direction substantially perpendicular to the respective side plate portions 3. The generally U-shaped configuration to be formed by the top plate portion 2 and the side plate portions 3 and 3 may includes a semi-circular configuration, a U-shaped configuration and a trapezoidal configuration. It is specifically noted that the top plate portion 2 is formed with a plurality of apertures 2*a* spaced apart from one another by a predetermined distance. Each of the side plate portions 3 and 3 disposed adjacent to the top plate portion 1 is formed with a plurality of slits 3*a* spaced apart from one another by the distance substantially the same as that of the apertures 2*a*. Each of the slits 3*a* is sized so as to permit insertion of a second support which will be explained later. Each of the flanges 4 and 4 is appropriately formed with a plurality of apertures 4*a* through which the flanges are attached to a third support which will be explained later. In the drawing, the slits 3*a* at the opposite ends of each of the side plate portions 3 and 3 are opened at their outer ends. It is noted, however, that they may be formed in a manner similar to the silts 3*a* disposed in the central portions of the side plate portions. Although the apertures 2*a* and the slits 3*a* are arranged so that they are coincident with each other at their central positions, they may be arranged so as to be somewhat offset with each other, if necessary.

Figure 7:
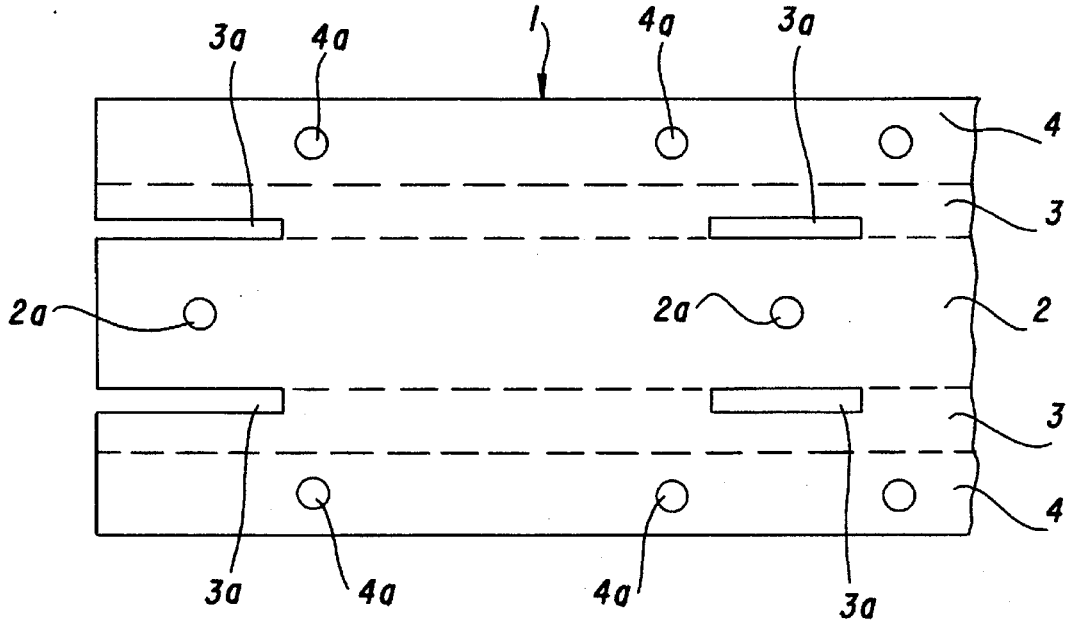
FIG. 7 is a plan view illustrating the first support shown in FIG. 6 in a developed fashion.
Figure 8:
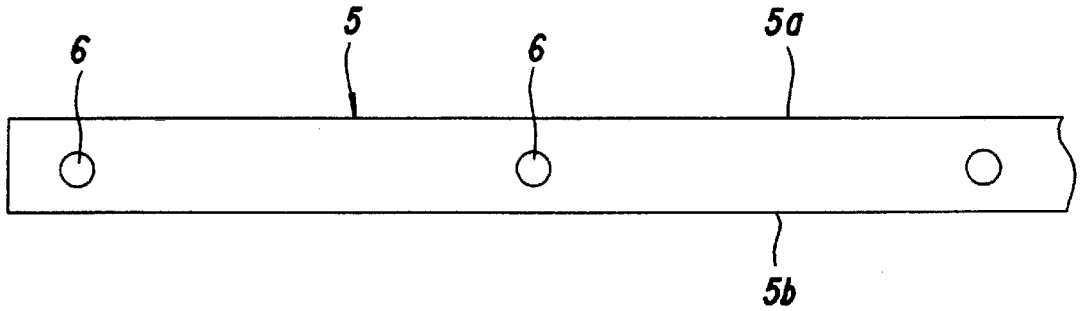
FIG. 8 is a plan view of a second support according to the invention.

A pair of first supports 1 are so arranged that the top plate portions 2, 2 are oppositely disposed, so as to form a set of first supports. A plurality of such sets of first supports are disposed at a constant interval. A second support 5 is inserted into each slits 3*a* of the first support 1, so as to form a grille. Each of the second supports 5 is formed from a metal member, for example of aluminum or steel, into a long size strip. Each of the second supports 5 is formed, along its longitudinal center, with a plurality of apertures 6 which are disposed so as to correspond to the apertures 2*a* of the first support 1. The first support 1 is formed, for example, by blanking a sheet metal so as to form the apertures 2*a* , 4*a* and the slits 3*a* therein, as shown in FIG. 7, and then bending the metal sheet along the dotted lines in FIG. 7 in a predetermined direction by means of roll bending or press bending, so as to obtain the configuration of FIG. 6.

Reference numeral 7 designates a block member. The block member 7 may include, for example, a glass block, a glass brick and a glass panel. The block member may also be formed from resin rather than glass. The block member 7 is supported by the first supports 1 and the second supports 5 arranged in a grating configuration(a form of a grating). Specifically, the opposite longitudinal ends of the block member 7 are supported by the flange portion 4, 4 of the first support 1, while the opposite side surfaces of the block member 7 are supported by the side plate portions 3, 3 of the first support 1. The upper and lower surfaces of the block member are supported by the upper edge portion 5*a* and the lower edge portion 5*b* of the second support 5.

The first supports 1 and the second supports 5 assembled into a grating configuration are tightened together by means of attachment means 8, 9. Specifically, the attachment means 8, such as a bolt, is inserted through the aperture 6 of the second support 5, the aperture 2*a* of the first support 1, the aperture 2*a* of the opposed first support 1, and the aperture 6 of the opposed second support 5. Then, the attachment means, such as a nut, is threaded onto the bolt. Thus, the opposite first supports 1, 1 become closer to one another, whereby the front surface and the rearward surface at the opposite ends of the block member 7 are tightly clamped by the flange portions 4, 4. Accordingly, the first support 1 and the second support 5 are unified.

A method for assembling the above-mentioned panel will be explained below.

A plurality of first supports 1 arranged vertically are spaced apart from one another by a distance substantially the same as the width of the block member 7, and arranged in two rows(front row and rearward row). The second support 5 is inserted into the lowermost slit 3*a* of each of the opposed first supports 1. The bolt 8 is inserted through the aperture 6 of the second support 5 secured to the first support 1 in the front row, the aperture 2*a* of the first support 1 in the front row, the aperture 2*a* of the first support 1 in the rearward row, and the aperture 6 secured to the first support 1 in the rearward row. The nut 9 is threaded onto the free end of the bolt 8 for temporary tightening operation. The block member 7 is inserted from the above into a space between the opposed first support 1, 1, such that the lower surface of the block member rests on the upper edge 5*a* of each of the opposed second supports 5, 5. Next or second block member 7 is disposed adjacent the above first block member 7 in the same manner. A third block member 7 is similarly disposed adjacent the above second block member 7. By this, the block members of the first stage (the first transverse row) are all disposed. Another second support 5 is inserted into the slit 3*a* next to the lowermost slit 3*a* of each of the opposed first supports 1, 1. Another bolt 8 is inserted into the apertures 2*a*, 6. Another nut 9 is threaded onto the free end of the above another bolt 8 for temporary tightening operation. Appropriate arrangement and adjustment are performed, so that the front surface and the rearward surface of the opposite ends of each of the block members 7 are supported by the opposed flange portions 4, 4 of the first supports 1, 1, while the opposed end surfaces of each of the block members 7 are engaged with the respective side plate portions 3. Then, the first supports 1 and the second supports 2 in the front row and the first supports 1 and the second supports 2 in the rearward row are tightened together by means of the lowermost bolt 8 and nut 9.

Subsequently, a first block member 7 of a second stage is inserted from the above into a space between the opposed first supports 1, 1, so that the lower surface of the first block member 7 is placed on the upper edge 5*a* of each of the second support of a second stage. Next or second block member 7 of the second stage is disposed adjacent the above first block member in the same manner. A third block member 7 is also disposed adjacent the above second block member. By this, the block members 7 in the second stage(the second transverse row) are all disposed. Another second support 5 is inserted into the slit 3*a* next to the above second lowermost slit 3*a* of each of the opposed first supports 1, 1. Another bolt 8 is inserted into the apertures 2*a*, 6. Another nut 9 is threaded onto the free end of the above another bolt 8 for temporary tightening operation. Appropriate arrangement and adjustment are performed as in the first stage, so that the front surface and the rearward surface of the opposite ends of each of the block members in the second stage 7 are supported by the opposed flange portions 4, 4 of the first supports 1, 1, while the opposed end surfaces of each of the block members 7 are engaged with the respective side plate portions 3. Then, the first supports 1 and the second supports 2 in the front row and the first supports 1 and the second supports 2 in the rearward row are tightened together by means of the bolt 8 and nut 9 respectively next to the lowermost bolt 8 and nut 9. The above operation will be repeated in substantially the same manner, so that the panel shown in FIG. 2 may be formed.

Figure 9:
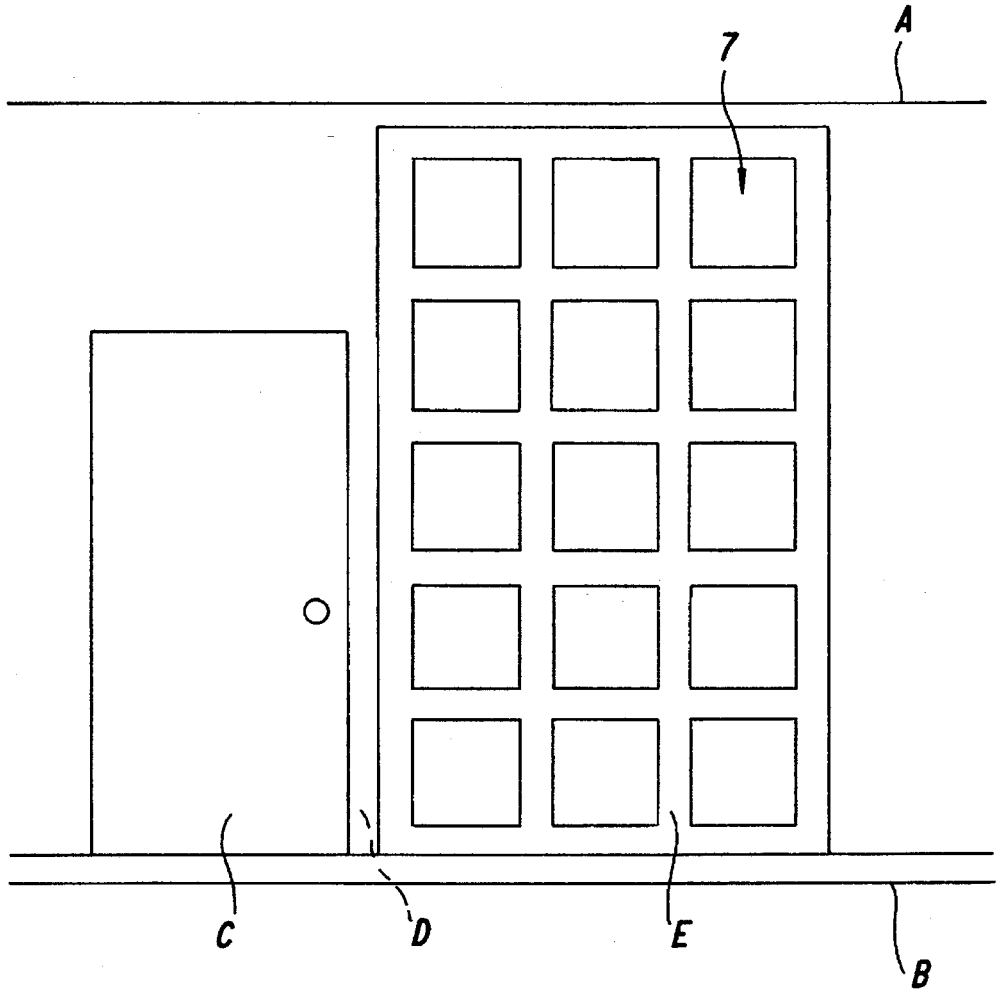
FIG. 9 is a front view illustrating a panel structure according to one embodiment of the invention.
Figure 10:
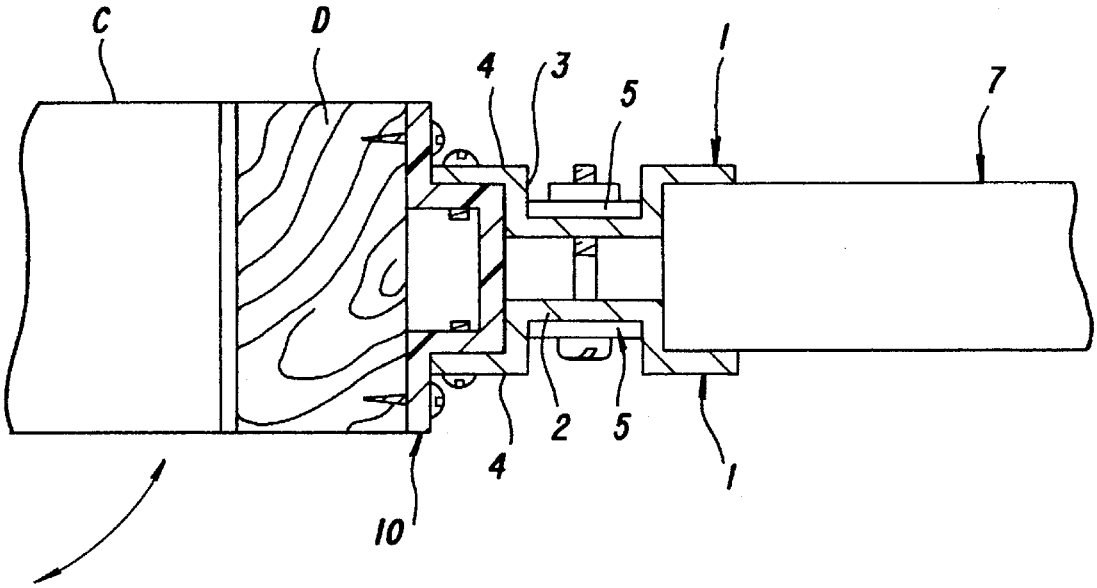
FIG. 10 is a cross-sectional view showing a main part of the panel structure shown in FIG. 9.
Figure 11:
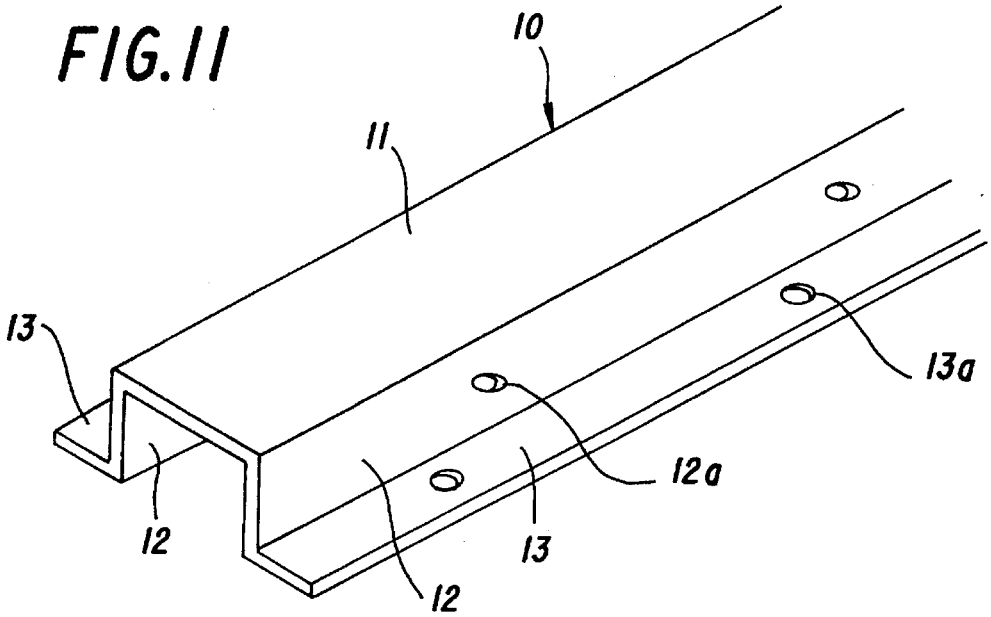
FIG. 11 is a perspective view of a third support according to the invention.

The thus constructed panel may be utilized as a partition between constructive elements, as shown in FIGS. 9 to 11. Specifically, the panel is disposed at a position adjacent to a door C between a ceiling wall A and a floor surface B, using a third support 10. In the illustrated embodiment, the third support 10 includes a top plate portion 11 of a plainer form, a side plate portions 12, 12 extending from the top plate portion in the same direction and forming, together with the top plate portion 11, a substantially U-shaped configuration, and a pair of flange portions 13, 13 extending outwardly from the respective side edges of the side plate portions 12, 12 in a direction perpendicular to the side edges of the side plate portions. Each of the side plate portions 12, 12 is formed with a plurality of apertures 12*a*, 12*a* disposed at a pitch or interval the same as that of the apertures 4*a*, 4*a* of the flange portions 4, 4 of the first supports 1, 1. The flange portions 13, 13 are formed with a plurality of apertures 13*a*, 13*a*.

The third support 10 is secured to a column D partly constituting a frame of a door C by means of screws. The flange portions 4, 4 of the first supports 1, 1 disposed at one end of the panel are placed around the side plate portions 12, 12 of the third support 10. A screw is threaded into the aperture 4*a* and aperture 12*a*, so that the panel is fixed to the third support 10. Then, exposed portions of the first support 1 and the second support 5 are covered with a decorative panel E. By this, fabrication work has been completed.

Depending upon a given condition of a fabrication site, the third support 10 may be preliminarily secured to one end of the panel, with the side plate portions 12, 12 of the third support 10 being secured to the flange portions 4, of the first support 1, 1 by means of screws. Such panel may be disposed at an appropriate position in a space in which the panel is utilized and then it is secured to a column D by means of screws.

It should be noted that the invention is not limited to the above embodiments. For example, the panel may be constructed by assembling each vertical row from one side in the transverse or horizontal direction, although, in the above embodiment, the panel is constructed by assembling each transverse or horizontal row from the lowermost one in a vertical direction. The uppermost stage may be assembled by moving the block members disposed in the stage next to the uppermost stage to the uppermost stage. The slits of the first support may be formed in any portion of the side plate portions, for example, in an area adjacent to the flange portions. In the illustrated embodiments, the first and second supports are secured together at their crossing portions by means of the attachment means. It is noted that the pair of first supports may be tightened together at non-crossing portions by means of the attachment means. The in attachment means may be a rivet place of a bolt/nut combination.

ADVANTAGE OF THE INVENTION

In accordance with the invention, the first support having the slits in the side plate portions and the second support are formed into a grating configuration by inserting the second support into the slits of the first support. The block members of a rectangular cross-section is disposed within each grating portion with the front surface and rearward surface of the opposite ends of each of the block members and the opposite side surface of each of the block members are supported by the flange portions and the side plates of the pair of first supports. The upper and lower surfaces of each of the block members is supported by the second supports. Thus, the panel may be easily assembled regardless of peripheral configuration of the block members. Furthermore, any adhesive such as joint sealant may be obviated, whereby contamination of a constructive element and its periphery may be prevented.

When the first support and the second support are tightly clamped together at their crossing-portions by means of the attachment means, supportability for the block members may be improved. Furthermore, mechanical strength of the panel may be increased, whereby the block members are prevented from being dislodged from the first and second supports when vibration and/or mechanical shock are applied to the panel.

The first and second supports are simple in construction. This easily permits reduction in weight of the supports themselves, and the entire panel.

The block members are supported by the first and second supports formed into a grating configuration. Thus, it is possible to change a size of the panel to a desired value at a rate of the size of the block members, by appropriately selecting the length of the first and second supports. Thus, applicability and flexibility may be improved.

The panel may be easily attached to the third support secured to a constructive element, using the first support. This permits reduction in construction period, together with applicability of the panel, for example, as a partition in a constructive element.

I claim:

1. A panel comprising a plurality of pairs of first supports, each first support including a top plate portion and a pair of side plate portions, said top plate portion and said side plate portions being formed into a substantially U-shaped configuration, each of said side plate portions being formed at its longitudinal edge with a flange portion extending laterally outwardly therefrom, each of said side plate portions being formed with a plurality of slits spaced apart from one another by a predetermined distance; a plurality of web-like second supports inserted into the slits in said first supports; and a block member having a rectangular cross-section, wherein said block member is supported, at opposite end surfaces and at opposite side surfaces, by said flange portions and said side plate portions of two of said pairs of first supports, and wherein said block member is supported, at opposite upper and lower surfaces, by said second supports inserted into said slits of said first supports.

2. A panel comprising a plurality of pairs of first supports, each first support including a top plate portion and a pair of side plate portions, said top plate portion and said side plate portions being formed into a substantially U-shaped configuration, each of said side plate portions being formed at its longitudinal edge with a flange portion extending laterally outwardly therefrom, said top plate portion and each side plate portions being formed with a plurality of apertures and slits spaced apart from one another by a predetermined distance, said pairs of first supports being positioned with respective top plate portions parallelly opposed; a plurality of elongated, web-like second supports inserted into the slits in said first supports, said second supports being formed with a plurality of apertures which correspond to said apertures in said top plate portion of said first supports; a plurality of block members, each block member having a rectangular cross-section; and fastening means including bolts and nuts; wherein said block members are supported, at opposite end surfaces and at opposite side surfaces, by said flange portions and said side plate portions of said of first supports, wherein said block members are supported, at opposite upper and lower surfaces, by said second supports inserted into said slits of said first supports, and wherein said first supports and said second supports are clamped together by said fastening means through their apertures, so that said block members are clamped by said first supports and said second supports.

3. A panel according to claim 1 or 2, wherein said first supports are oriented in a vertical direction, while said second supports are oriented in a transverse direction.

4. A panel structure comprising:

a panel including a plurality of pairs of first supports, each first support having a top plate portion and pair of side plate portions, said top plate portion and said side plate portions being formed into a substantially U-shaped configuration, each of said side plate portions being formed at its longitudinal edge with a flange portion extending laterally outwardly therefrom, each of said side plate portions being formed with a plurality of slits spaced apart from one another by a predetermined distance, said pairs of first supports being positioned with respective top plate portions parallelly opposed; a plurality of web-like second supports inserted into the slits in said first supports; and a block member having a rectangular cross-section, wherein said block member is supported, at opposite end surfaces and at opposite side surfaces, by said flange portions and said side plate portions of two of said pairs of first supports, and wherein said block member is supported, at opposite upper and lower surfaces, by said second supports inserted into said slits of said first supports; and at least two third supports, each third support including a top plate portion and side plate portions formed into a substantially U-shaped configuration, each of said third support side plate portions being formed at its longitudinal edge with a flange portion extending outwardly therefrom, said side plate portions of each said third support being clamped by opposed flanges of said pair of first supports disposed at one end of said panel, said panel being attached to said side plate portions of said at least two third supports.

* * * * *